United States Patent [19]

Morrison

[11] Patent Number: 4,753,720

[45] Date of Patent: Jun. 28, 1988

[54] PROCESS FOR IMPROVING THE OCTANE NUMBER OF CRACKED GASOLINES

[75] Inventor: Roger A. Morrison, Deptford, N.J.

[73] Assignee: Mobil Oil Corporation, New York, N.Y.

[21] Appl. No.: 40,707

[22] Filed: Apr. 16, 1987

Related U.S. Application Data

[63] Continuation of Ser. No. 769,791, Aug. 26, 1985, abandoned, which is a continuation of Ser. No. 701,312, Feb. 13, 1985, abandoned.

[51] Int. Cl.[4] ..... C01G 35/06

[52] U.S. Cl. ..... 208/135; 208/70; 585/415; 585/417; 585/419; 585/531; 585/533; 585/666; 585/670

[58] Field of Search ..... 585/415, 417, 419, 531, 585/533, 666, 670; 208/70, 135

[56] References Cited

U.S. PATENT DOCUMENTS

| | | | |
|---|---|---|---|
| 3,236,909 | 2/1966 | Winnick | 585/666 |
| 3,636,125 | 1/1972 | Hoppstock | 585/666 |
| 3,756,942 | 9/1973 | Cattanach | 208/137 |
| 3,758,403 | 9/1973 | Rosinski | 208/120 |
| 3,760,024 | 9/1973 | Cattanach | 585/415 |
| 3,843,741 | 10/1974 | Yan . | |
| 3,894,931 | 7/1975 | Nace | 208/73 |
| 3,894,934 | 7/1975 | Owen | 208/78 |
| 3,950,242 | 4/1976 | Garwood | 208/70 |
| 3,960,978 | 6/1976 | Givens et al. | 585/531 |
| 4,001,106 | 1/1977 | Plank | 208/75 |
| 4,021,502 | 5/1977 | Plank | 585/533 |
| 4,125,566 | 11/1978 | Dinh et al. | 208/70 |
| 4,227,992 | 10/1980 | Garwood et al. | 208/135 |
| 4,324,940 | 4/1982 | Dessau | 585/466 |
| 4,356,338 | 10/1982 | Young | 208/135 |
| 4,418,235 | 11/1983 | Haag et al. | 585/533 |
| 4,465,884 | 8/1984 | Degnan et al. | 585/415 |
| 4,490,241 | 12/1984 | Chou | 208/75 |

FOREIGN PATENT DOCUMENTS 0093477 11/1983 European Pat. Off. .

OTHER PUBLICATIONS

Asinger, *Mono-Olefins Chemistry and Technology*, Pergamon Press (1968) pp. 1092-1100.

*Primary Examiner*—Curtis R. Davis
*Attorney, Agent, or Firm*—Alexander J. McKillop; Michael G. Gilman; Malcolm D. Keen

[57] ABSTRACT

Olefin containing gasolines are upgraded to improve octane number with less than 5 wt.% yield loss by contacting such gasolines at elevated temperatures with acidic zeolites having alpha values between 5 and 100.

15 Claims, 6 Drawing Sheets

Δ R+O VS C1-C4 MAKE FOR VARIOUS CHARGES
STEAMED H-ZSM-12 α=11
75-250° F FCC GASOLINE (CHARGE R+O=89.8)
FCC (89.2)
TCC (88.8)
75-425° F
75-425°F
75-310°F (91.1)
DISTILLATE
MODE FCC
ΔR+O
C1-C4 MADE
0
.5
1
1.5
2
2.5
3
0
1
2
3
4
5

Δ R+O VS C1-C4 MAKE, EFFECT OF SOME PROCESS VARABLES
75-425°F FCC GASOLINE
ZSM-12 α=11
ZSM-12 α=11, 2/1 H2/HC
ZSM-5 α=10, RUN AT 300 TO 600°F
ZSM-5 α=10, RUN AT 200 AND 400°F, OCTANE LOSS, COKING
ΔR+O
C1-C4 MADE
0
.5
1
1.5
2
2.5
3
0
1
2
3
4
5

PROCESS FOR IMPROVING THE OCTANE NUMBER OF CRACKED GASOLINES

This is a continuation of copending application Ser. No. 769,791, filed Aug. 26, 1985, and now abandoned, which was a continuation of application Ser. No. 701,312 filed Feb. 13, 1985, and now abandoned.

BACKGROUND OF THE INVENTION

1. Field of the Invention

This invention relates to hydrocarbon conversion. It more particularly relates to an improved process for upgrading the octane number of a gasoline-boiling fraction.

2. Description of the Prior Art

Modern petroleum refinery technology is capable of reforming naphthas which are paraffinic and/or naphthenic in nature in order to increase the octane number thereof. Such reforming is traditionally carried out in contact with platinum type reforming catalysts and is a widely used commercial refinery process. Platinum reforming is particularly well suited for use in upgrading naphthenic fractions to aromatic fractions.

More recently it has been discovered that naphtha fractions, which are not particularly naphthenic or which may contain substantially no naphthenes at all, can be conveniently aromatized in good, commercially acceptable yields by converting such feeds, under relatively severe conditions, in contact with ZSM-5 and related crystalline aluminosilicate zeolite catalysts. Highly aromatic liquid yields of upwards of 30 percent have been readily achieved by this process.

In a similar process, aromatic containing feeds, such as reformates, have been upgraded in a manner whereby their aromatic contents have been increased by contacting such feeds with this same kind of catalyst, that is, ZSM-5 and related intermediate pore aluminosilicate zeolites. This latter process is believed to operate by selectively cracking aliphatics in the feed to produce active fragments at least some of which alkylate existing aromatics in the feed whereby increasing the highly desirable, high octane aromatic content thereof while decreasing the less desirable, low octane paraffin content thereof.

The principal differences between these two processes are the feeds being converted and the severity of conversion conditions. The first aforesaid process is principally valuable for converting a predominantly aliphatic feed and operates at about 650° to 1500° F. at a space velocity of about 1 to 15 WHSV. The second aforesaid process is principally valuable for converting a feed which is already rich in aromatics and operates at about 500° to 1000° F. It will be seen that the operating conditions overlap to some extent as do the feeds. It is probable that some cracking-alkylation and some aromatization take place in both processes. The distinction between the processes is perhaps better expressed as one of conversion predominance with the more severe conditions favoring new aromatic ring formation and the less severe conditions favoring alkylation of preformed or newly created aromatic rings.

In either case, it has been shown that the processes referred to above are improved when the ZSM-5 catalyst is modified to include a certain proportion, e.g. up to about 10 weight percent, of zinc or cadmium, or other similarly promoting metal therein. Such metal is suitably incorporated with the zeolite by cation exchange, impregnation and/or vapor deposition. It has also been shown that the further inclusion of copper into such a catalyst composition is beneficial especially in that the loss during regeneration of zinc and/or cadmium is significantly reduced thereby.

The following patents comprise at least a partial list of those patents directed to processes such as described above for upgrading hydrocarbon fractions over acidic crystalline aluminosilicate zeolites to improved gasoline products.

U.S. Pat. No. 3,756,942 discloses increasing the aromatic content of a light gasoline formed by fluid catalytic cracking (FCC) by conversion of the gasoline over ZSM-5 zeolite.

U.S. Pat. No. 3,760,024 also discloses a process for producing aromatic compounds by contacting $C_2$–$C_4$ paraffins, olefins or mixtures thereof with ZSM-5 and recovering the aromatic compounds.

U.S. Pat. No. 3,775,501 discloses improving the yield of aromatics from a hydrocarbon feed selected from the group consisting of aliphatic olefins and paraffins by contacting the hydrocarbon feed in air or oxygen with a crystalline aluminosilicate zeolite such as ZSM-5.

U.S. Pat. No. 3,827,968 discloses a process for manufacturing gasoline by contacting $C_2$–$C_5$ olefins with ZSM-5 under such conditions as to oligomerize the olefins and subsequently passing the oligomerized olefins over ZSM-5 at aromatizing conditions to form a product having an enhanced aromatic content.

U.S. Pat. No. 3,890,218 discloses a process for upgrading the octane number of hydrocarbon fractions boiling in the naphtha range and having a low octane number by contacting the naphtha fraction over an intermediate pore zeolite such as ZSM-5 in which the activity of the zeolite has been modified such as by steaming so as to increase the high octane liquid yield by shape selective cracking-alkylation mechanism and an aliphatic hydrocarbon aromatization process. The process is preferably operated at conditions which are intermediate between the optimum conditions for the respective conversion mechanisms. Among the feeds which are useful in the aforementioned patent are cracked gasolines. The preferred feeds are hydrocarbon compositions containing 0 to 20 wt.% aromatics, predominantly $C_5$–$C_8$ aromatics, and about 60–100 wt.% straight and branched chain paraffins and olefins with minimal amounts of naphthenes.

U.S. Pat. No. 3,953,366 discloses a process for the aromatization of hydrocarbons and the alkylation of aromatic rings by contacting a hydrocarbon feed such as a cracked gasoline fraction with ZSM-5 and related zeolites which has rhenium deposited thereon.

U.S. Pat. No. 3,960,978 discloses converting gaseous $C_2$–$C_5$ olefins to an olefinic gasoline by passing the olefin feed over a ZSM-5 zeolite catalyst. The zeolite catalyst can be steamed to a low alpha activity value.

U.S. Pat. No. 4,021,502 discloses producing a gasoline by passing a feed stock of $C_2$–$C_5$ olefins or mixtures thereof with $C_1$–$C_5$ paraffins over ZSM-4, ZSM-12, ZSM-18, chabazite or zeolite beta.

U.S. Pat. No. 4,227,992 discloses a process for separating ethylene from light olefins by contact with ZSM-5 under conditions such that the $C_3+$ olefins are converted to both gasoline and fuel oil.

U.S. Pat. No. 4,396,497 describes the treatment of gasoline boiling range hydrocarbons to increase the octane number thereof by contact with a gamma alumina catalyst.

Another process recently used to increase the octane of gasoline boiling fractions involves the addition of ZSM-5 and related intermediate pore zeolites to the conventional cracking catalyst such as zeolites of the X or Y faujasite variety during the cracking of gas oils to gasoline products. Examples of patents which describe such a process include U.S. Pat. Nos. 3,894,931; 3,894,903; and 3,894,934.

One important consideration involved in the upgrading of gasoline fractions in addition to boosting the octane thereof is obtaining the highest possible liquid yield. Thus, although the technology referred to above is excellent in upgrading the quality of gasoline boiling range fragments, hydrocarbon conversion over ZSM-5 under cracking, alkylation or aromatizing conditions has resulted in substantial loss of gasoline yield in the form of light gases, i.e., $C_1$–$C_4$.

SUMMARY OF THE INVENTION

An important aspect of the present invention resides in improving the octane number of a gasoline boiling fraction without excessive yield loss. In accordance with the process of this invention, the octane number of an olefin-containing hydrocarbon feed having a boiling range of 75° to about 425° F. is increased with less than 5 wt.% yield loss by contacting such feed with an acidic crystalline aluminosilicate zeolite catalyst which has been modified so as to have an alpha value of between about 5 to about 100. The process operates in the absence of hydrogen. The improved octane number of the gasoline product is believed to be due to isomerization of olefins in the feed since the gasoline product of this invention has a negligible change in aromatic content relative to the feed as well as little change in the carbon number of the paraffin and olefin components of the feed.

DESCRIPTION OF THE PREFERRED EMBODIMENTS

Figure 1:
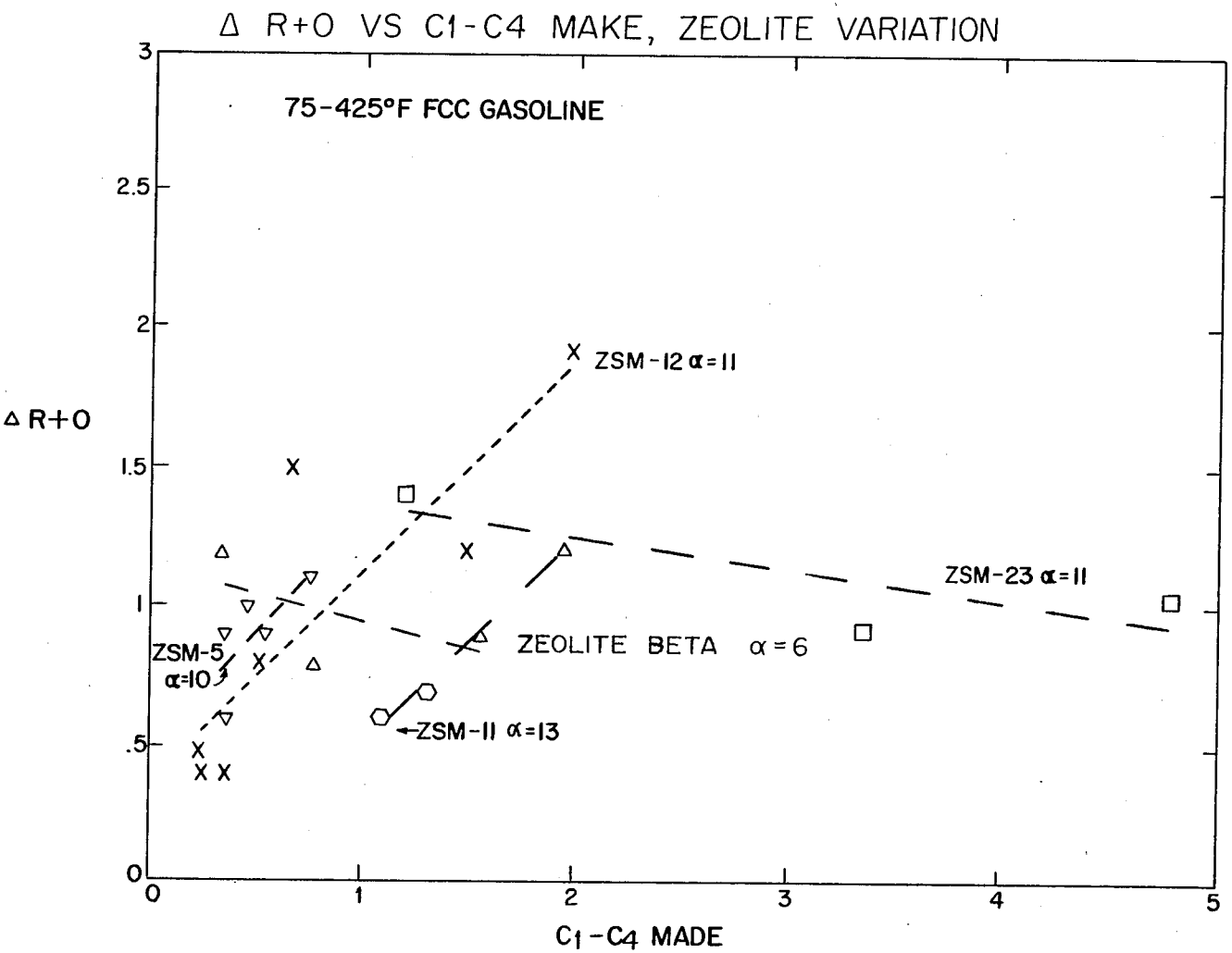
FIG. 1 is a plot illustrating increased octane versus make of $C_1$–$C_4$ after treating a full range FCC gasoline (75°–425° F. boiling point range) with five types of acid zeolite catalysts in fixed-bed operation.

The process of the present invention has been found to increase the octane number of gasoline boiling fractions with only minimal, i.e., less than about 5 wt.%, yield loss, typically less than about 1 wt.% yield loss. The yield loss is in the form of $C_1$–$C_4$ gas make. In accordance with this invention, the gasoline feed is passed through a fixed bed of acidic crystalline aluminosilicate zeolite catalysts for conversion of the gasoline feed to a gasoline product of improved octane number. The preferred operating temperatures are about 700°–900° F., preferred space velocities are at least about 10 WHSV and the preferred pressure is about 0–50 psig. The process is run in the absence of hydrogen.

Feeds suitable for octane improvement in accordance with the present invention include any FCC or TCC gasoline. Thus, any 75°–250° F. low end point FCC gasoline; 75°–310° F. distillate range FCC gasoline or full range 75°–425° F. TCC or FCC gasolines are applicable in this invention. Such gasolines generally have olefin contents of at least 20 wt.%. Depending on where such gasoline is cut, olefin contents of at least 30 wt.% and 40 wt.% are typical. Other useful gasolines which can be upgraded include gasolines obtained from conversion of methanol to aromatic gasoline over zeolite catalysts, oligomerization of olefins over intermediate pore zeolites to olefinic gasolines, pyrolysis gasoline, etc.

The octane increase which is obtained by the process of the present invention is more readily seen in the low end point gasolines, i.e., 75°–250° F. and 75°–310° F. cracked gasolines. This result is consistent with an olefin isomerization reaction mechanism inasmuch as the lighter weight gasolines contain a greater olefin concentration typically comprising about 50 wt.% than full range gasolines. Thus, it has been found that at about 1 wt.% gasoline yield loss, i.e., $C_1$–$C_4$, upon conversion over the zeolite catalyst useful in this invention, the octane increase of the product relative to feed is about:

2–2.5 R+O for 75°–250° F. FCC gasoline 1.5–2 R+O for 75°–310° F. Distillate mode FCC gasoline 1–1.5 R+O for full range 75°–425° F. TCC or FCC gasolines Gasoline yield losses are primarily due to $C_1$–$C_4$ gas make. However, over 90% of these light gases comprise $C_3$–$C_4$ olefins which are suitable for subsequent alkylation with isobutane and can be added to increase gasoline product yields and further improve octane number.

Catalysts useful in the present invention can be chosen from any acid catalyst, although, intermediate pore size aluminosilicate zeolites are best suited. Such preferred catalysts have relatively low aging rates.

Zeolites useful for the crystalline aluminosilicate component of this invention include the acidic forms of: zeolite X, described in U.S. Pat. No. 2,882,244; zeolite Y, described in U.S. Pat. No. 3,130,007; mordenite; zeolite L, described in U.S. Pat. No. 3,216,789; zeolite T, described in U.S. Pat. No. 2,950,952; and zeolite beta, described in U.S. Pat. No. 3,308,069.

The preferred catalysts for use in the present invention are crystalline aluminosilicate zeolites which are characterized as intermediate pore size zeolites. Such zeolites have a constraint index ranging from about 1 to about 12 and are further characterized by having a silica to alumina framework ratio of at least 12 and preferably at least about 30.

The latter class of zeolites defined as useful herein include ZSM-5, ZSM-11, ZSM-12, ZSM-23, ZSM-35, ZSM-38, ZSM-48 and other similar materials.

ZSM-5 is described in greater detail in U.S. Pat. No. 3,702,886, the entire contents of which is incorporated herein by reference.

ZSM-11 is described in U.S. Pat. No. 3,709,979. That description is incorporated in its entirety herein by reference.

ZSM-12 is described in U.S. Pat. No. 3,832,449. That entire description is incorporated herein by reference.

ZSM-23 is described in U.S. Pat. No. 4,076,842. That entire description is incorporated herein by reference.

ZSM-35 is described in U.S. Pat. No. 4,016,245. The description of that zeolite, in its entirety, is incorporated herein by reference.

ZSM-38 is more particularly described in U.S. Pat. No. 4,046,859, the entire description of which is incorporated herein by reference.

ZSM-48 is described in U.S. Pat. No. 4,375,573 and its entire description of ZSM-48 is incorporated herein by reference.

While those zeolites which have Constraint Indices within the above range are useful, it is preferred to use the intermediate pore zeolites. Thus, ZSM-12 and zeolite beta although useful, are not necessarily preferred.

To avoid substantial cracking of the paraffin and olefin contents of the gasoline and subsequent aromatization, the activity of the catalyst must be modified. Accordingly, the acid activity of the catalyst is reduced to an alpha of about 5 to about 100, preferably about 10 to about 50. Any method suitable to reduce the high acid activity of the zeolite catalysts can be utilized including; extensive base exchange with alkali metal cations, high silica to alumina framework ratios, zeolite dilution in a matrix and steaming. Steaming is the preferred method.

The alpha value of a crystalline aluminosilicate zeolite is related to the activity of the catalyst for cracking normal hexane. The alpha value from a hexane-cracking test can be determined in accordance with the method set forth by P. B. Weisz and J. N. Mialey in Journal of Catalysis, Vol. 4, No. 4, August 1969, pages 527–529, which description is herein incorporated by reference.

The following examples are for the purposes of further illustrating the process of the present invention.

For all of the following examples, the catalysts were passed through 20×60 mesh sieves and pretreated in flowing hydrogen at 900° F. for 1 hour prior to use. After the catalyst had been heated to operating temperatures, the charge was run over the hot catalyst with only the pressure drop across the catalyst bed and no added gas.

Material balances were made by collection of the product stream in a liquid nitrogen-cooled trap and subsequent expansion of the gases into a precalibrated, constant volume system. Liquid and gas analysis was by gas chromatography. The liquid product for octane determination was collected in ice followed by a dry ice-acetone trap system. No distillation was done since most of the runs involved less than 1% $C_1$–$C_4$ make. However, where the gas make was greater than 1%, a correction was made in the reported octane value in order to discount light gas dissolved in the liquid. This correction is about 0.1 R+O for each 1% $C_1$–$C_4$ make and has been in the Figures.

EXAMPLE 1

Various zeolites, e.g., ZSM-5, -11, -12, -23, and zeolite beta were used to convert a full range FCC gasoline (75°–425° F.) having the composition by weight shown in Table 1. Each catalyst was tested at various temperatures within the operable range of 700°–900° F. Tables 2–4 illustrate the gasoline product composition at two of such tested temperatures for each zeolite. The improvement in octane number relative to yield loss is shown in FIG. 1 for each zeolite. The optimum improvement in octane numbers lies around 1% $C_1$–$C_4$ make.

TABLE 1

| FULL RANGE FCC GASOLINE | |
|---|---|
| $C_1$ | |
| $C_2$ | |
| $C_2$= | |
| $C_3$ | |
| $C_3$= | |
| ISO-$C_4$ | 0.03 |
| N-$C_4$ | 0.20 |
| $C_4$= | 0.57 |
| ISO-$C_5$ | 7.96 |
| N-$C_5$ | — |
| $C_5$= | 8.61 |
| 2,2 DM-$C_4$ | 0.10 |
| CYCLO-$C_5$ | 0.68 |
| 2,3 DM-$C_4$ | 0.69 |
| 2-M-$C_5$ | 4.16 |
| 3-M-$C_5$ | 2.24 |
| N-$C_6$ | 1.08 |
| $C_6$= | 3.53 |
| M-CYCLO-$C_5$ | 2.67 |
| BENZENE | 1.51 |
| CYCLO-$C_6$ | 0.34 |
| $C_7$'S | 11.95 |
| N-$C_7$ | — |
| TOLUENE | 4.73 |
| $C_8$'S | 6.59 |
| N-$C_8$ | — |
| $C_8$ AR. | 9.85 |
| $C_9$+ PAR. | — |
| $C_9$ AR. | 9.85 |
| $C_{10}$ AR. | 8.39 |
| $C_{10}$–$C_{12}$ AR. | 14.27 |
| NAPHTHALENES | — |
| M-NAPHTHALENES | — |
| $C_{13}$+'S | — |
| R + O | 89.20 |

TABLE 2

| CATALYST | ZSM-5[1] | ZSM-5 | ZSM-12[2] | ZSM-12 |
|---|---|---|---|---|
| TEMPERATURE, °F. | 702.00 | 800.00 | 875.00 | 850.00 |
| PRESSURE, PSIG | 30.00 | 50.00 | 30.00 | 30.00 |
| WHSV | 10.00 | 10.00 | 10.00 | 10.00 |
| HELIUM, HC | 0.00 | 0.00 | 0.00 | 0.00 |
| TIME ON STREAM, HRS. | 23.40 | 164.50 | 23.80 | 119.50 |
| PRODUCT DIST., WT % | | | | |
| $C_1$ | 0.00 | 0.00 | 0.02 | 0.00 |
| $C_2$ | 0.00 | 0.00 | 0.05 | 0.02 |
| $C_2$= | 0.01 | 0.02 | 0.04 | 0.01 |
| $C_3$ | 0.01 | 0.02 | 0.04 | 0.01 |
| $C_3$= | 0.31 | 1.12 | 0.84 | 0.08 |
| ISO-$C_4$ | 0.03 | 0.08 | 0.04 | 0.03 |
| N-$C_4$ | 0.15 | 0.18 | 0.18 | 0.17 |
| $C_4$= | 0.83 | 1.92 | 1.47 | 0.49 |
| ISO-$C_5$ | 6.68 | 7.70 | 6.97 | 6.79 |
| N-$C_5$ | 0.15 | 0.35 | 0.16 | 0.13 |
| $C_5$= | 7.96 | 9.06 | 8.54 | 8.04 |
| 2,2 DM-$C_4$ | 0.02 | 0.11 | 0.07 | 0.10 |
| CYCLO-$C_5$ | 0.66 | 0.68 | 0.67 | 0.65 |
| 2,3 DM-$C_4$ | 0.65 | 0.63 | 0.67 | 0.69 |
| 2-M-$C_5$ | 3.87 | 3.95 | 4.04 | 3.95 |
| 3-M-$C_5$ | 2.09 | 2.11 | 2.17 | 2.17 |
| N-$C_6$ | 1.04 | 1.06 | 1.11 | 1.06 |
| $C_6$= | 3.21 | 2.89 | 3.20 | 3.41 |
| M-CYCLO-$C_5$ | 2.80 | 2.78 | 2.82 | 2.73 |
| BENZENE | 1.47 | 1.42 | 1.47 | 1.50 |
| CYCLO-$C_6$ | 0.39 | 0.33 | 0.32 | 0.30 |
| $C_7$'S | 11.90 | 11.05 | 11.51 | 12.19 |
| N-$C_7$ | 0.00 | 0.00 | 0.00 | 0.00 |
| TOLUENE | 4.67 | 4.67 | 4.76 | 4.84 |
| $C_8$'S | 6.98 | 6.06 | 6.23 | 6.79 |
| N-$C_8$ | 0.00 | 0.00 | 0.00 | 0.00 |

TABLE 2-continued

| | | | | |
|---|---|---|---|---|
| $C_8$ AR. | 10.20 | 9.71 | 10.02 | 10.21 |
| $C_9$ + *PAR.* | 0.00 | 0.00 | 0.00 | 0.00 |
| $C_9$ AR. | 10.09 | 9.51 | 9.74 | 10.17 |
| $C_{10}$ AR. | 8.78 | 8.30 | 8.41 | 8.71 |
| $C_{10}$–$C_{12}$ AR. | 15.04 | 14.30 | 14.45 | 14.79 |
| NAPHTHALENES | 0.00 | 0.00 | 0.00 | 0.00 |
| M-NAPHTHALENES | 0.00 | 0.00 | 0.00 | 0.00 |
| $C_{13}$+'S | 0.00 | 0.01 | 0.00 | 0.00 |
| WT % CONV, TOTAL | 2.42 | 4.61 | 3.46 | 2.56 |
| TO $C_1$–$C_4$ | 0.74 | 2.68 | 1.96 | 0.26 |
| R + O (CHARGE = 89.2) | 90.80 | 91.10 | 91.40 | 89.70 |

[1]$SiO_2/Al_2O_3$ = 70; steamed α = 10
[2]$SiO_2/Al_2O_3$ = 54; steamed α = 11

TABLE 3

| CATALYST | ZSM-11[3] | ZSM-11 | ZSM-23[4] | ZSM-23 |
|---|---|---|---|---|
| TEMPERATURE, °F. | 750.00 | 750.00 | 898.00 | 802.00 |
| PRESSURE, PSIG | 30.00 | 30.00 | 30.00 | 30.00 |
| WHSV | 10.00 | 10.00 | 10.00 | 10.00 |
| HELIUM, HC | 0.00 | 0.00 | 0.00 | 0.00 |
| TIME ON STREAM, HRS. | 21.40 | 45.30 | 22.90 | 97.40 |
| PRODUCT DIST., WT % | | | | |
| $C_1$ | 0.00 | 0.02 | 0.00 | 0.00 |
| $C_2$ | 0.00 | 0.05 | 0.04 | 0.00 |
| $C_2$= | 0.02 | 0.01 | 0.23 | 0.02 |
| $C_3$ | 0.00 | 0.14 | 0.16 | 0.00 |
| $C_3$= | 0.79 | 0.42 | 2.48 | 0.54 |
| ISO-$C_4$ | 0.03 | 0.20 | 0.10 | 0.02 |
| N-$C_4$ | 0.22 | 0.21 | 0.19 | 0.15 |
| $C_4$= | 1.62 | 1.20 | 2.83 | 1.07 |
| ISO-$C_5$ | 6.06 | 5.90 | 6.27 | 6.35 |
| N-$C_5$ | 0.16 | 0.12 | 0.15 | 0.13 |
| $C_5$= | 10.04 | 9.87 | 6.97 | 7.86 |
| 2,2 DM-$C_4$ | 0.00 | 0.00 | 0.01 | 0.06 |
| CYCLO-$C_5$ | 0.84 | 0.84 | 0.64 | 0.67 |
| 2,3 DM-$C_4$ | 0.56 | 0.57 | 0.71 | 0.70 |
| 2-M-$C_5$ | 3.47 | 3.44 | 3.60 | 3.89 |
| 3-M-$C_5$ | 1.74 | 1.74 | 2.04 | 2.09 |
| N-$C_6$ | 1.26 | 1.27 | 1.04 | 1.08 |
| $C_6$= | 3.69 | 3.75 | 2.46 | 3.19 |
| M-CYCLO-$C_5$ | 2.91 | 2.92 | 2.47 | 2.79 |
| BENZENE | 1.79 | 1.82 | 1.42 | 1.48 |
| CYCLO-$C_6$ | 0.50 | 0.50 | 0.28 | 0.40 |
| $C_7$'S | 11.06 | 11.28 | 10.40 | 11.91 |
| N-$C_7$ | 0.00 | 0.00 | 0.00 | 0.00 |
| TOLUENE | 4.96 | 5.01 | 4.97 | 4.70 |
| $C_8$'S | 6.17 | 6.32 | 6.18 | 6.75 |
| N-$C_8$ | 0.00 | 0.00 | 0.00 | 0.00 |
| $C_8$ AR. | 9.03 | 9.10 | 10.59 | 10.19 |
| $C_9$+ PAR. | 0.00 | 0.00 | 0.00 | 0.00 |
| $C_9$ AR. | 9.95 | 10.07 | 10.14 | 9.98 |
| $C_{10}$ AR. | 8.23 | 8.35 | 8.64 | 8.68 |
| $C_{10}$–$C_{12}$ AR. | 14.91 | 15.11 | 14.97 | 15.31 |
| NAPHTHALENES | 0.00 | 0.00 | 0.00 | 0.00 |
| M-NAPHTHALENES | 0.00 | 0.00 | 0.00 | 0.00 |
| $C_{13}$+'S | 0.00 | 0.00 | 0.00 | 0.00 |
| WT % CONV, TOTAL | 3.96 | 3.56 | 6.97 | 3.01 |
| TO $C_1$–$C_4$ | 1.93 | 1.31 | 5.33 | 1.19 |
| R + O (CHARGE = 89.2) | 92.80 | 92.30 | 91.40 | 90.80 |

[3]Steamed α = 13.
[4]Steamed α = 11.

TABLE 4

| CATALYST | BETA[5] | BETA |
|---|---|---|
| TEMPERATURE, °F. | 850.00 | 899.00 |
| PRESSURE, PSIG | 30.00 | 30.00 |
| WHSV | 10.00 | 10.00 |
| HELIUM, HC | 0.00 | 0.00 |
| TIME ON STREAM, HRS. | 21.80 | 45.80 |
| PRODUCT DIST., WT % | | |
| $C_1$ | 0.00 | 0.02 |

TABLE 4-continued

| | | |
|---|---|---|
| $C_2$ | 0.05 | 0.11 |
| $C_2$= | 0.02 | 0.05 |
| $C_3$ | 0.03 | 0.14 |
| $C_3$= | 0.09 | 0.19 |
| ISO-$C_4$ | 0.03 | 0.03 |
| N-$C_4$ | 0.17 | 0.20 |
| $C_4$= | 0.45 | 0.59 |
| ISO-$C_5$ | 6.51 | 6.57 |
| N-$C_5$ | 0.15 | 0.15 |
| $C_5$= | 7.72 | 7.83 |
| 2,2 DM-$C_4$ | 0.14 | 0.04 |
| CYCLO-$C_5$ | 0.79 | 0.74 |
| 2,3 DM-$C_4$ | 0.70 | 0.69 |
| 2-M-$C_5$ | 3.76 | 3.77 |
| 3-M-$C_5$ | 2.09 | 2.07 |
| N-$C_6$ | 0.93 | 0.94 |
| $C_6$= | 3.58 | 3.49 |
| M-CYCLO-$C_5$ | 2.64 | 2.63 |
| BENZENE | 1.46 | 1.41 |
| CYCLO-$C_6$ | 0.42 | 0.45 |
| $C_7$'S | 11.94 | 11.88 |
| N-$C_7$ | 0.00 | 0.00 |
| TOLUENE | 4.81 | 4.81 |
| $C_8$'S | 7.05 | 6.88 |
| N-$C_8$ | 0.00 | 0.00 |
| $C_8$ AR. | 10.36 | 10.31 |
| $C_9$+ PAR. | 0.00 | 0.00 |
| $C_9$ AR. | 10.42 | 10.26 |
| $C_{10}$ AR. | 8.82 | 8.77 |
| $C_{10}$–$C_{12}$ AR. | 14.89 | 14.96 |
| NAPHTHALENES | 0.00 | 0.00 |
| M-NAPHTHALENES | 0.00 | 0.00 |
| $C_{13}$+'S | 0.00 | 0.00 |
| WT % CONV, TOTAL | 2.44 | 2.36 |
| TO $C_1$–$C_4$ | 0.33 | 0.77 |
| R + O (CHARGE = 89.2) | 90.40 | 90.10 |

[5]H-Beta; $SiO_2/Al_2O_3$ = 40; steamed α = 6.

Table 5 illustrates the octane improvement for each of the tested zeolites at 1% gas make.

TABLE 5

| Zeolite | Octane Improvement with Various Zeolites at 1% $C_1$–$C_4$ Make<br>Octane Improvements, R + O |
|---|---|
| ZSM-5 | 1.2 |
| ZSM-11 | 0.7 |
| ZSM-12 | 1.1 |
| ZSM-23 | 1.3 |
| Zeolite beta | 0.9 |

At this level, all of the catalysts improve octane, suggesting that only acidity is required to accomplish this chemistry.

In general, the light gases which are formed are olefinic. ZSM-5 is the best, yielding about 95% olefins vs about 90% for ZSM-12. In terms of activity, ZSM-5, -11, and -23, are about 75°–100° F. more active than ZSM-12 at similar alphas.

EXAMPLE 2

Figure 2:
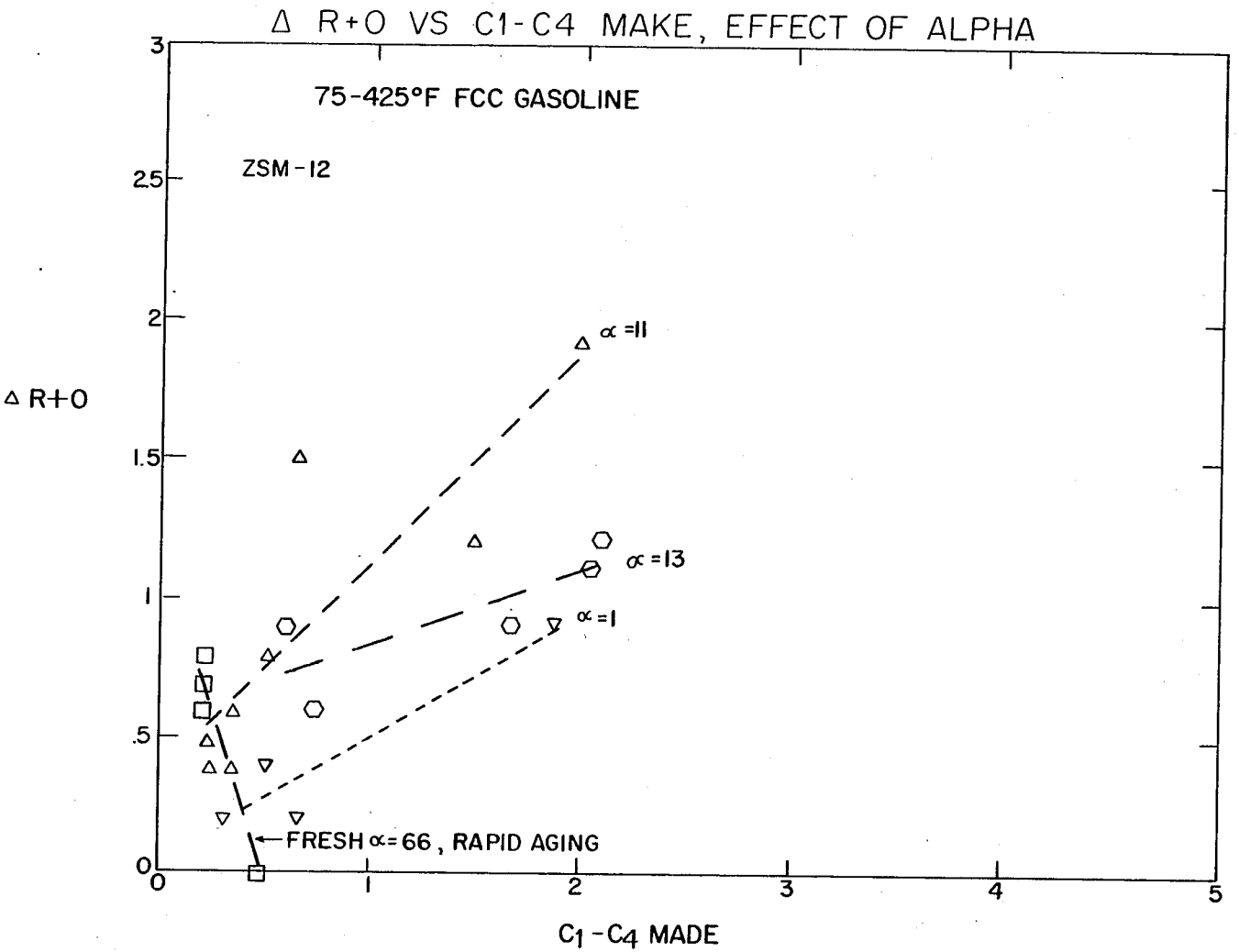
FIG. 2 is a plot illustrating the same relationship as in FIG. 1 with a ZSM-12 catalyst having widely different alpha values.
Figure 3:
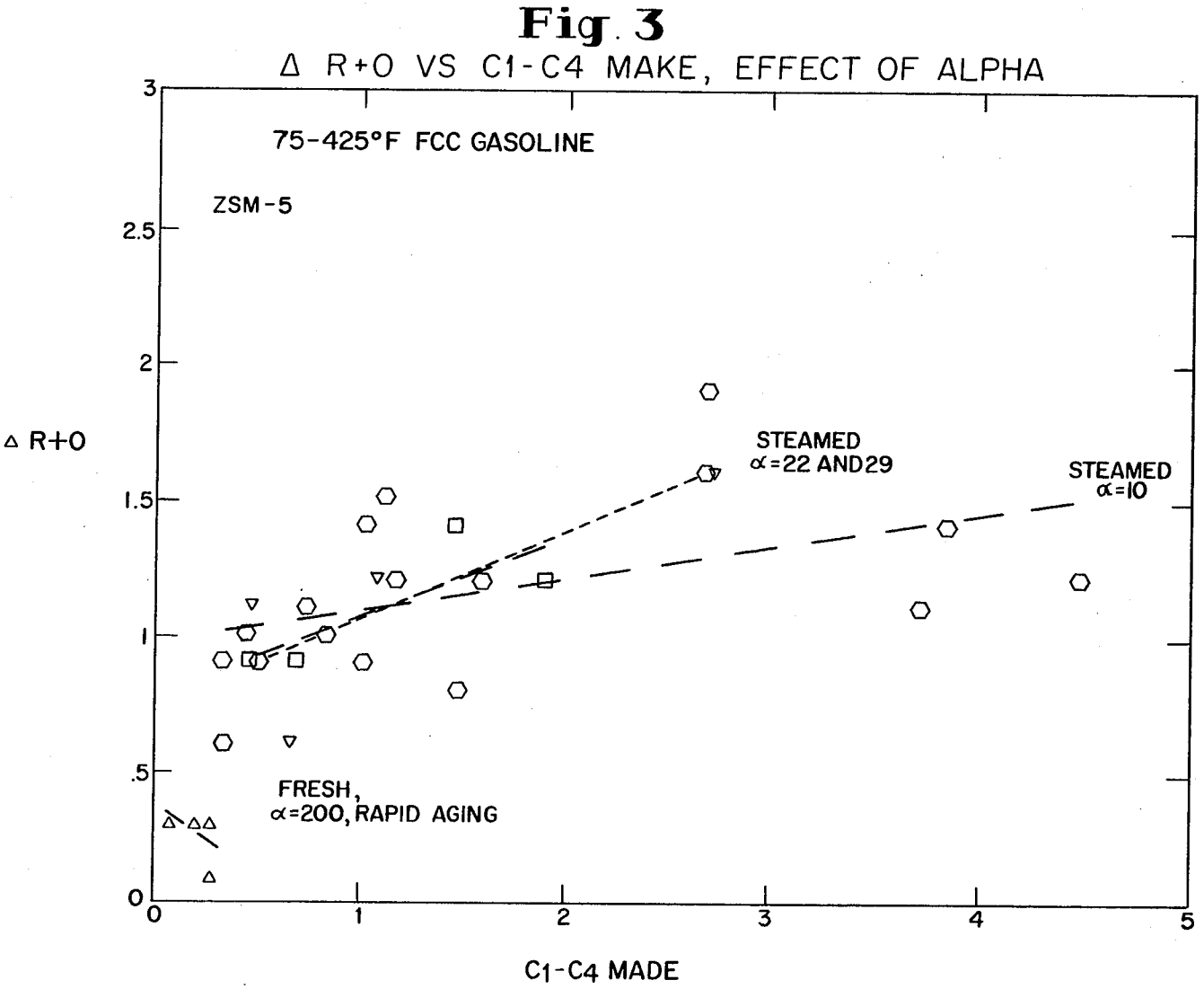
FIG. 3 is a plot similar to FIG. 2 for a ZSM-5 catalyst.

In this example, ZSM-5 and ZSM-12 were used to crack a full range FCC gasoline. Various alpha values for each catalyst were tested. The results are summarized in FIGS. 2 (ZSM-12) and 3 (ZSM-5). Different space velocities were used for the ZSM-12 runs, but space velocity is not important nor does it effect conclusions on alpha variations.

A prominent feature is that fresh ZSM-5 and ZSM-12 both age rapidly at more than 100° F./100 hrs. Time On Stream (TOS). It is not entirely clear whether this aging is due to nitrogen poisons, coking, or both, but the relatively high temperatures should be sufficient to minimize nitrogen sorption, and coking is the more likely cause. At the other extreme, ZSM-12 with an alpha of 1 does not have sufficient activity to achieve all of the desired chemistry. At moderate alphas, the yield octane appear similar in the range of 10–30 with perhaps a slight advantage for an alpha of about 30 in octane improvement and activity.

EXAMPLE 3

ZSM-5 and ZSM-12 were used to improve the octane number of a full range TCC gasoline having the composition illustrated in Table 6. Tables 7–8 show the gasoline product composition obtained after conversion of the TCC gasoline at representative temperatures.

Figure 4:
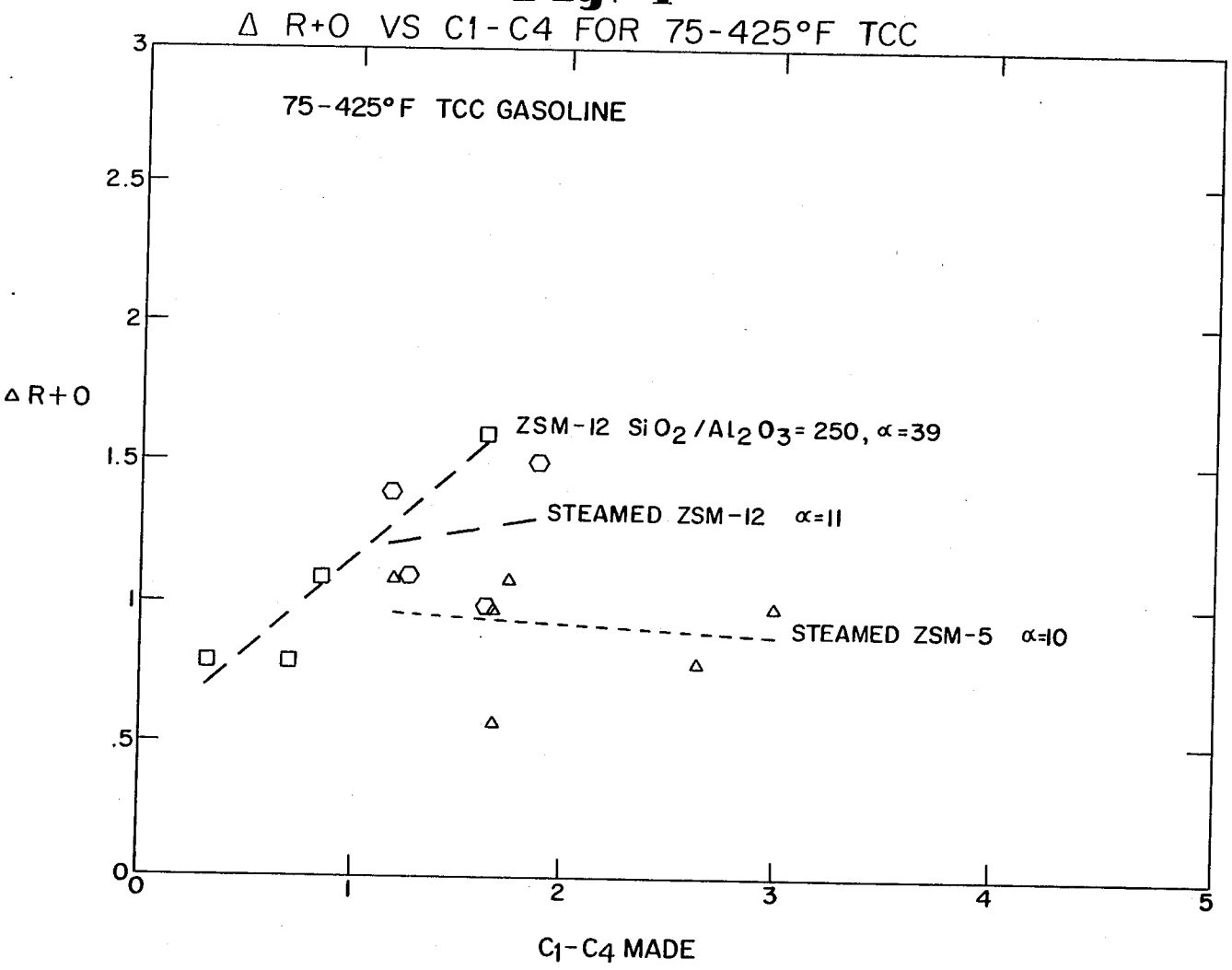
FIG. 4 is a graph illustrating the same relationship as in FIGS. 1–3 with steamed and unsteamed ZSM-12 and steamed ZSM-5 catalysts.

The conversion of TCC gasoline is similar to conversion of FCC gasoline, as indicated by FIG. 4. The yield octane is 1 R+O/1% $C_1$–$C_4$ make. At higher octane, ZSM-12 may be more effective than ZSM-5. One of the ZSM-12's used was a high $SiO/_2Al_2O_3$=250, alpha=39 catalyst. The yield octane was equivalent to that of the steamed catalysts, suggesting that lower activity via either steaming or use of a high $SiO_2/Al_2O_3$ is acceptable.

TABLE 6

| FULL RANGE TCC GASOLINE | |
|---|---|
| $C_1$ | |
| $C_2$ | |
| $C_2$= | |
| $C_3$ | |
| $C_3$= | |
| ISO-$C_4$ | 0.06 |
| N-$C_4$ | 0.36 |
| $C_4$= | 0.80 |
| ISO-$C_5$ | 10.50 |
| N-$C_5$ | 1.74 |
| $C_5$= | 2.89 |
| 2,2 DM-$C_4$ | 0.04 |
| CYCLO-$C_5$ | 0.18 |
| 2,3 DM-$C_4$ | 1.08 |
| 2-M-$C_5$ | 4.44 |
| 3-M-$C_5$ | 2.81 |
| N-$C_6$ | 0.82 |
| $C_6$= | 1.26 |
| M-CYCLO-$C_5$ | 2.69 |
| BENZENE | 1.34 |
| CYCLO-$C_6$ | — |
| $C_7$'S | 10.80 |
| N-$C_7$ | — |
| TOLUENE | 5.01 |
| $C_8$'S | 6.18 |
| N-$C_8$ | — |
| $C_8$ AR. | 10.70 |
| $C_9$+ PAR. | — |
| $C_9$ AR. | 10.91 |
| $C_{10}$ AR. | 8.87 |
| $C_{10}$–$C_{12}$ AR. | 16.55 |
| NAPHTHALENES | 0.00 |
| M-NAPHTHALENES | 0.00 |
| $C_{13}$+'S | 0.00 |
| R + O | 88.8 |

TABLE 7

| CATALYST | ZSM-5[1] | ZSM-5 | ZSM-12[2] | ZSM-12 |
|---|---|---|---|---|
| TEMPERATURE, °F. | 799.00 | 824.00 | 900.00 | 926.00 |
| PRESSURE, PSIG | 50.00 | 50.00 | 30.00 | 30.00 |
| WHSV | 10.00 | 10.00 | 10.00 | 10.00 |
| HELIUM, HC | 0.00 | 0.00 | 0.00 | 0.00 |
| TIME ON STREAM, HRS. | 23.20 | 170.90 | 71.30 | 95.30 |
| PRODUCT DIST., WT % | | | | |
| $C_1$ | 0.00 | 0.00 | 0.01 | 0.00 |
| $C_2$ | 0.00 | 0.00 | 0.04 | 0.07 |
| $C_2$= | 0.00 | 0.00 | 0.03 | 0.06 |
| $C_3$ | 0.07 | 0.11 | 0.03 | 0.05 |
| $C_3$= | 0.62 | 0.87 | 0.42 | 0.75 |

TABLE 7-continued

| | | | | |
|---|---|---|---|---|
| ISO-$C_4$ | 0.18 | 0.44 | 0.05 | 0.06 |
| N-$C_4$ | 0.43 | 0.49 | 0.34 | 0.34 |
| $C_4$= | 1.37 | 1.65 | 1.18 | 1.50 |
| ISO-$C_5$ | 10.46 | 10.42 | 9.44 | 9.10 |
| N-$C_5$ | 1.71 | 1.75 | 1.74 | 0.13 |
| $C_5$= | 4.17 | 3.98 | 3.38 | 5.14 |
| 2,2 DM-$C_4$ | 0.03 | 0.04 | 0.04 | 0.06 |
| CYCLO-$C_5$ | 0.26 | 0.65 | 0.20 | 0.46 |
| 2,3 DM-$C_4$ | 0.98 | 0.76 | 1.05 | 0.82 |
| 2-M-$C_5$ | 4.21 | 4.15 | 4.41 | 4.28 |
| 3-M-$C_5$ | 2.67 | 2.66 | 2.79 | 2.80 |
| N-$C_6$ | 0.78 | 0.77 | 0.81 | 0.81 |
| $C_6$= | 1.21 | 1.22 | 1.26 | 1.29 |
| M-CYCLO-$C_5$ | 2.74 | 2.70 | 2.79 | 2.71 |
| BENZENE | 1.14 | 1.09 | 1.11 | 1.18 |
| CYCLO-$C_6$ | 0.22 | 0.28 | 0.28 | 0.23 |
| $C_7$'S | 10.60 | 10.42 | 10.85 | 10.74 |
| N-$C_7$ | 0.00 | 0.00 | 0.00 | 0.00 |
| TOLUENE | 5.11 | 4.97 | 5.16 | 5.18 |
| $C_8$'S | 5.92 | 5.85 | 6.06 | 5.88 |
| N-$C_8$ | 0.00 | 0.00 | 0.00 | 0.00 |
| $C_8$ AR. | 10.77 | 10.57 | 10.98 | 10.93 |
| $C_9$+ PAR. | 0.00 | 0.00 | 0.00 | 0.00 |
| $C_9$ AR. | 9.83 | 9.74 | 10.15 | 10.12 |
| $C_{10}$ AR. | 7.94 | 7.97 | 8.22 | 8.17 |
| $C_{10}$–$C_{12}$ AR. | 16.56 | 16.43 | 17.20 | 17.16 |
| NAPHTHALENES | 0.00 | 0.00 | 0.00 | 0.00 |
| M-NAPHTHALENES | 0.00 | 0.00 | 0.00 | 0.00 |
| $C_{13}$+'S | 0.01 | 0.00 | 0.00 | 0.00 |
| WT % CONV, TOTAL | 3.68 | 4.59 | 3.24 | 6.40 |
| TO $C_1$–$C_4$ | 1.73 | 2.62 | 1.14 | 1.83 |
| R + O (CHARGE = 88.8) | 90.10 | 89.90 | 90.50 | 90.60 |

[1] $SiO_2/Al_2O_3$ = 70; steamed $\alpha$ = 10.
[2] $SiO_2/Al_2O_3$ = 54, steamed $\alpha$ = 11.

TABLE 8

| CATALYST | ZSM-12[3] |
|---|---|
| TEMPERATURE, °F. | 799.00 |
| PRESSURE, PSIG | 50.00 |
| WHSV | 10.00 |
| HELIUM, HC | 0.00 |
| TIME ON STREAM, HRS. | 99.00 |
| PRODUCT DIST., WT % | |
| $C_1$ | 0.00 |
| $C_2$ | 0.00 |
| $C_2$= | 0.00 |
| $C_3$ | 0.00 |
| $C_3$= | 0.02 |
| ISO-$C_4$ | 0.07 |
| N-$C_4$ | 0.36 |
| $C_4$= | 0.58 |
| ISO-$C_5$ | 9.63 |
| N-$C_5$ | 1.51 |
| $C_5$= | 3.94 |
| 2,2 DM-$C_4$ | 0.04 |
| CYCLO-$C_5$ | 0.26 |
| 2,3 DM-$C_4$ | 0.98 |
| 2-M-$C_5$ | 4.15 |
| 3-M-$C_5$ | 2.66 |
| N-$C_6$ | 0.75 |
| $C_6$= | 1.28 |
| M-CYCLO-$C_5$ | 2.66 |
| BENZENE | 1.01 |
| CYCLO-$C_6$ | 0.33 |
| $C_7$'S | 10.88 |
| N-$C_7$ | 0.00 |
| TOLUENE | 5.17 |
| $C_8$'S | 6.36 |
| N-$C_8$ | 0.00 |
| $C_8$ AR. | 11.09 |
| $C_9$+ PAR. | 0.00 |
| $C_9$ AR. | 10.39 |
| $C_{10}$ AR. | 8.46 |
| $C_{10}$–$C_{12}$ AR. | 17.42 |
| NAPHTHALENES | 0.00 |
| M-NAPHTHALENES | 0.00 |
| $C_{13}$+'S | 0.00 |
| WT % CONV, TOTAL | 3.51 |
| TO $C_1$–$C_4$ | 0.30 |

TABLE 8-continued

| | |
|---|---|
| R + O (CHARGE = 88.8) | 89.90 |

[3]$SiO_2/Al_2O_3$ = 250; α = 39.

EXAMPLE 4

Figure 5:
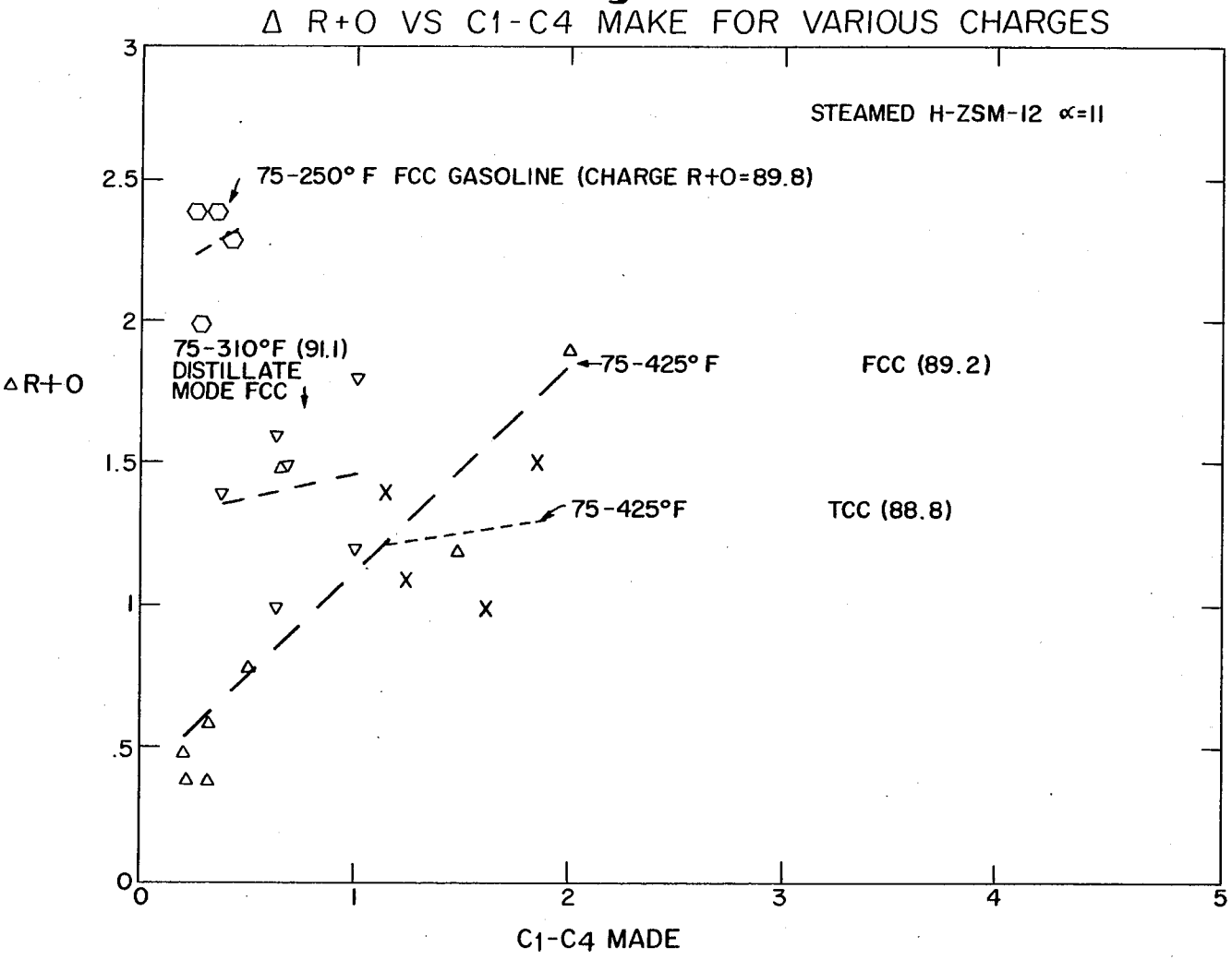
FIG. 5 is a plot illustrating the variations in the changes in octane number as a function of $C_1$–$C_4$ make for various FCC and TCC gasolines with steamed ZSM-12 catalysts.

If the mechanism of octane improvement involves olefin reactions, then as the charge boiling point decreases, the amount of octane improvement should increase due to greater olefin concentration in the front end. Tables 9–11 show the data for distillate-mode FCC gasoline (75°–310° F. with and without ZSM-5 in the cracking catalyst) and a 75°–250° F. cut of FCC gasoline. These results along with the previous ZSM-12 data on full range FCC and TCC gasolines are plotted in FIG. 5.

Table 12 illustrates the effect of boiling range on octane improvement at 0.7% light gas make.

TABLE 12

Effect of Boiling Range on Octane Improvement at 0.7% $C_1$–$C_4$ Make

| Charge Stock | Octane Improvement, R + O |
|---|---|
| 75–250° F. FCC | 2.4 |
| 75–310° F. FCC | 1.4 |
| 75–425° F. TCC | 1.2 |
| 75–425° F. FCC | 1.0 |

The results are in line with expectation. Yield octane improves in the order 75°–250° F.>75°–310° F.>75°–425° F. The 75°–310° F. distillate-mode FCC gasoline made with ZSM-5 as a cracking additive is improved about 0.5 R+O. However, some fixed bed chemistry has apparently taken place in the cracking step and the amount of octane improvement in subsequent processing is thus limited.

The amount of octane improvement with the lighter charges is 1.5 to 2.5 R+O per 1% $C_1$–$C_4$ make. This is very efficient octane production and suggests that the economics would be most favorable in a situation where the TCC gasoline is cut under 350° F. in order to maximize distillate.

EXAMPLE 5

Figure 6:
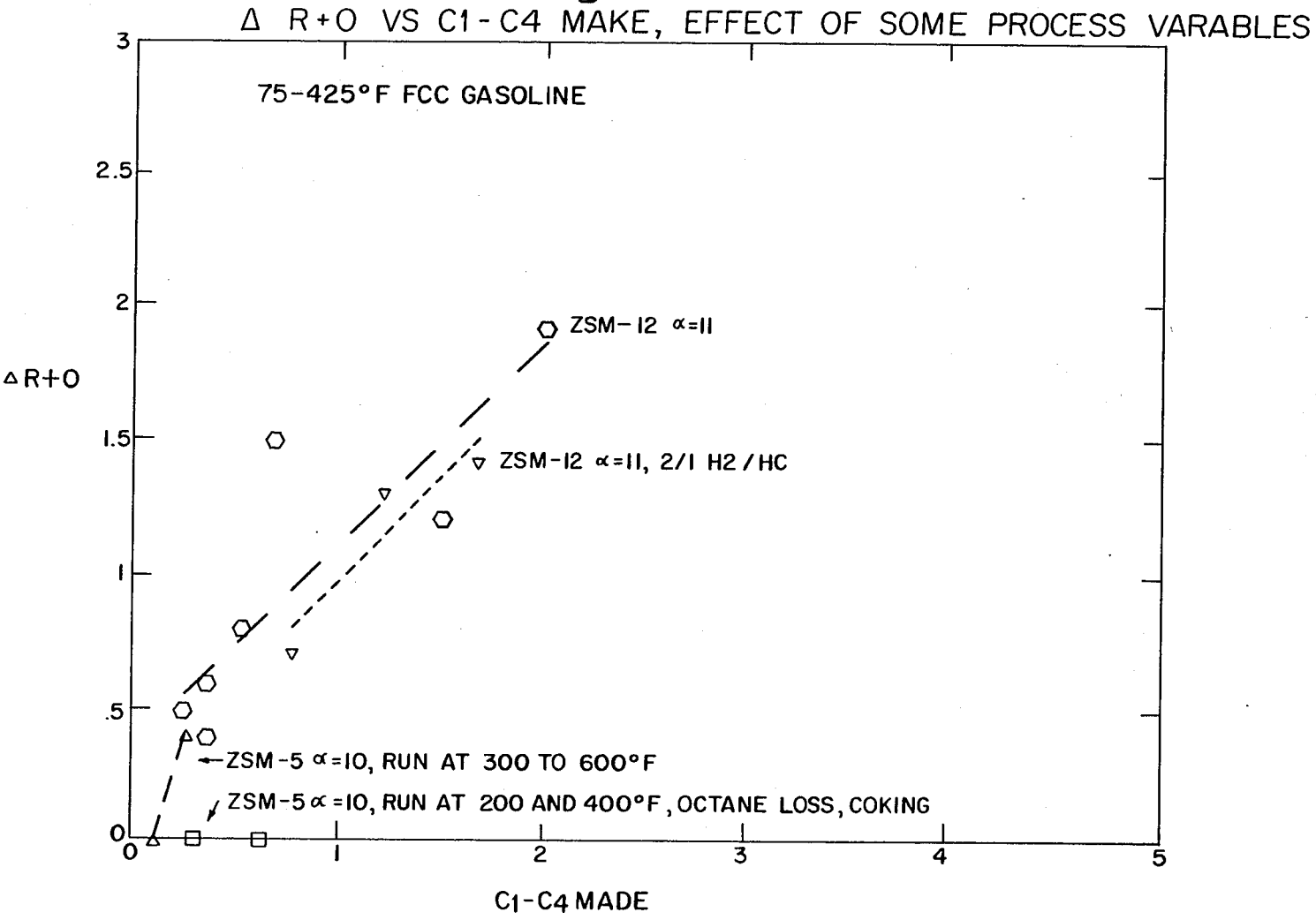
FIG. 6 is a graph illustrating the effect of process variables on the change in octane versus $C_1$–$C_4$ make upon fixed bed treatment of several FCC and TCC gasolines with several zeolite catalysts.

A full range FCC gasoline was converted over ZSM-5 and ZSM-12 at varying process conditions. Results are shown in Tables 13–15 and FIG. 6.

It would be convenient if the reaction would occur at the temperature that gasoline is taken off the distillation tower. However, the results show that no octane improvement is obtained until approximately 0.5% conversion to $C_1$–$C_4$ takes place, and this does not occur until approximately 650° F. Thus low temperature operation is not possible unless nitrogen poisons are removed by preadsorption in a guard chamber, solvent extraction or other conventional means.

Increasing pressure is very detrimental to octane improvement. Coking is severe at higher pressure and probably some oligomerization occurs since there is an increase in heavy ends. No octane improvement results and in fact a decrease occurs. Adding hydrogen to the system does not influence the reaction or the yield octane. Without metal, no hydrogenation occurs in the olefinic light gases. This also suggests that hydrogen will not affect aging.

TABLE 9

| CATALYST | ZSM-12[1] | ZSM-12 | |
|---|---|---|---|
| TEMPERATURE, °F. | 800.00 | 900.00 | |
| PRESSURE, PSIG | 30.00 | 30.00 | |
| WHSV | 10.00 | 10.00 | |
| HELIUM, HC | 0.00 | 0.00 | |
| TIME ON STREAM, HRS. | 21.80 | 108.70 | |
| PRODUCT DIST., WT % | | | |
| $C_1$ | 0.05 | 0.03 | CHARGE DISTILLATE-MODE FCC GASOLINE |
| $C_2$ | 0.01 | 0.14 | |
| $C_2$= | 0.02 | 0.07 | |
| $C_3$ | 0.02 | 0.08 | |
| $C_3$= | 0.32 | 0.29 | |
| ISO-$C_4$ | 0.00 | 0.01 | 0.01 |
| N-$C_4$ | 0.03 | 0.12 | 0.13 |
| $C_4$= | 0.97 | 0.79 | 0.56 |
| ISO-$C_5$ | 1.92 | 1.75 | 1.88 |
| N-$C_5$ | 0.10 | 0.08 | — |
| $C_5$= | 10.30 | 9.96 | 10.73 |
| 2,2 DM-$C_4$ | 0.10 | 0.15 | 0.12 |
| CYCLO-$C_5$ | 0.64 | 0.67 | 0.83 |
| 2,3 DM-$C_4$ | 0.44 | 0.51 | 0.60 |
| 2-M-$C_5$ | 2.11 | 2.09 | 2.03 |
| 3-M-$C_5$ | 0.64 | 0.63 | 0.62 |
| N-$C_6$ | 0.00 | 0.00 | — |
| $C_6$= | 8.51 | 8.50 | 8.78 |
| M-CYCLO-$C_5$ | 2.55 | 2.47 | 2.27 |
| BENZENE | 2.82 | 2.83 | 2.95 |
| CYCLO-$C_6$ | 0.42 | 0.38 | 0.46 |
| $C_7$'S | 16.39 | 16.82 | 16.55 |
| N-$C_7$ | 0.00 | 0.00 | — |
| TOLUENE | 5.70 | 5.62 | 5.54 |
| $C_8$'S | 14.04 | 14.11 | 14.14 |
| N-$C_8$ | 0.00 | 0.00 | — |
| $C_8$ AR. | 10.91 | 10.71 | 10.35 |
| $C_9$+ PAR. | 0.00 | 0.00 | — |
| $C_9$ AR. | 20.98 | 21.20 | 21.45 |
| $C_{10}$ AR. | 0.00 | 0.00 | 100.00 |
| $C_{10}$–$C_{12}$ AR. | 0.00 | 0.00 | |
| NAPHTHALENES | 0.00 | 0.00 | |
| M-NAPHTHALENES | 0.00 | 0.00 | |
| $C_{13}$+'S | 0.00 | 0.00 | |
| WT % CONV, TOTAL | 3.53 | 2.79 | |
| TO $C_1$–$C_4$ | 0.98 | 1.00 | |
| R + O (CHARGE = 91.1) | 93.30 | 92.60 | |

[1]Steamed α = 11.

TABLE 10

| CATALYST | ZSM-12[2] | ZSM-12 | |
|---|---|---|---|
| TEMPERATURE, °F. | 801.00 | 850.00 | |
| PRESSURE, PSIG | 30.00 | 30.00 | |
| WHSV | 10.00 | 10.00 | |
| HELIUM, HC | 0.00 | 0.00 | |
| TIME ON STREAM, HRS. | 23.30 | 92.50 | |
| PRODUCT DIST., WT % | | | |
| $C_1$ | 0.00 | 0.00 | DISTILLATE MODE FCC GASOLINE (H-ZSM-5 ADDITIVE IN CRACKING CATALYST) |
| $C_2$ | 0.01 | 0.03 | |
| $C_2$= | 0.02 | 0.02 | |
| $C_3$ | 0.01 | 0.02 | |
| $C_3$= | 0.46 | 0.30 | |
| ISO-$C_4$ | 0.01 | 0.00 | |
| N-$C_4$ | 0.05 | 0.01 | 0.03 |
| $C_4$= | 0.89 | 0.66 | 0.26 |
| ISO-$C_5$ | 3.18 | 3.15 | 3.21 |

TABLE 10-continued

| | | | |
|---|---|---|---|
| N-$C_5$ | 0.09 | 0.09 | — |
| $C_5$= | 15.41 | 15.35 | 15.91 |
| 2,2 DM-$C_4$ | 0.08 | 0.03 | — |
| CYCLO-$C_5$ | 0.56 | 1.35 | 1.47 |
| 2,3 DM-$C_4$ | 0.60 | 0.00 | — |
| 2-M-$C_5$ | 3.59 | 3.57 | 3.61 |
| 3-M-$C_5$ | 1.14 | 1.16 | 1.16 |
| N-$C_6$ | 0.00 | 0.00 | — |
| $C_6$= | 9.30 | 9.48 | 9.69 |
| M-CYCLO-$C_5$ | 3.70 | 3.62 | 3.46 |
| BENZENE | 2.69 | 2.69 | 2.81 |
| CYCLO-$C_6$ | 0.00 | 0.00 | — |
| $C_7$'S | 14.95 | 15.23 | 15.33 |
| N-$C_7$ | 0.00 | 0.00 | — |
| TOLUENE | 5.39 | 5.27 | 5.14 |
| $C_8$'S | 11.00 | 11.07 | 11.15 |
| N-$C_8$ | 0.00 | 0.00 | — |
| $C_8$ AR. | 8.44 | 8.51 | 8.27 |
| $C_9$+ PAR. | 0.00 | 0.00 | — |
| $C_9$ AR. | 18.43 | 18.37 | 18.50 |
| $C_{10}$ AR. | 0.00 | 0.00 | 100.00 |
| $C_{10}$–$C_{12}$ AR. | 0.00 | 0.00 | |
| NAPHTHALENES | 0.00 | 0.00 | |
| M-NAPHTHALENES | 0.00 | 0.00 | |
| $C_{13}$+'S | 0.00 | 0.00 | |
| WT % CONV, TOTAL | 2.68 | 1.50 | |
| TO $C_1$–$C_4$ | 1.20 | 0.85 | |
| R + O (CHARGE = 93.5) | 94.50 | 94.40 | |

[2]Steamed $\alpha$ = 11.

TABLE 11

| CATALYST | ZSM-12[3] | ZSM-12 | ZSM-12 | |
|---|---|---|---|---|
| TEMPERATURE, °F. | 750.00 | 801.00 | 900.00 | |
| PRESSURE, PSIG | 30.00 | 30.00 | 30.00 | |
| WHSV | 10.00 | 10.00 | 10.00 | |
| HELIUM, HC | 0.00 | 0.00 | 0.00 | |
| TIME ON STREAM, HRS. | 21.30 | 69.00 | 114.70 | |
| PRODUCT DIST., WT % | | | | |
| $C_1$ | 0.00 | 0.00 | 0.01 | 75–250° F. FCC GASOLINE |
| $C_2$ | 0.00 | 0.01 | 0.06 | |
| $C_2$= | 0.01 | 0.00 | 0.03 | |
| $C_3$ | 0.00 | 0.00 | 0.03 | |
| $C_3$= | 0.30 | 0.02 | 0.07 | |
| ISO-$C_4$ | 0.02 | 0.01 | 0.01 | 0.01 |
| N-$C_4$ | 0.21 | 0.21 | 0.20 | 0.19 |
| $C_4$= | 0.88 | 0.43 | 0.48 | 0.37 |
| ISO-$C_5$ | 7.53 | 7.88 | 7.56 | 8.03 |
| N-$C_5$ | 0.24 | 0.21 | 0.24 | — |
| $C_5$= | 14.37 | 15.82 | 15.40 | 15.84 |
| 2,2 DM-$C_4$ | 0.07 | 0.12 | 0.14 | 0.09 |
| CYCLO-$C_5$ | 1.43 | 1.62 | 1.70 | 1.70 |
| 2,3 DM-$C_4$ | 1.15 | 1.21 | 1.20 | 1.25 |
| 2-M-$C_5$ | 6.91 | 7.26 | 7.33 | 7.35 |
| 3-M-$C_5$ | 3.62 | 3.85 | 3.86 | 3.84 |
| N-$C_6$ | 2.67 | 2.56 | 2.61 | 2.68 |
| $C_6$= | 7.17 | 9.06 | 8.98 | 9.08 |
| M-CYCLO-$C_5$ | 5.76 | 5.89 | 5.88 | 5.70 |
| BENZENE | 3.49 | 3.87 | 3.84 | 3.90 |
| CYCLO-$C_6$ | 0.86 | 0.86 | 0.88 | 0.91 |
| $C_7$'S | 20.31 | 22.72 | 22.91 | 22.68 |
| N-$C_7$ | 0.00 | 0.00 | 0.00 | — |
| TOLUENE | 7.44 | 7.97 | 8.26 | 8.01 |
| $C_8$'S | 13.50 | 7.00 | 6.94 | 6.92 |
| N-$C_8$ | 0.00 | 0.00 | 0.00 | — |
| $C_8$ AR. | 1.19 | 1.20 | 1.25 | 1.19 |
| $C_9$+ PAR. | 0.00 | 0.00 | 0.00 | — |
| $C_9$ AR. | 0.30 | 0.14 | 0.11 | 0.09 |
| $C_{10}$ AR. | 0.22 | 0.02 | 0.02 | 0.03 |
| $C_{10}$–$C_{12}$ AR. | 0.30 | 0.01 | 0.01 | 0.04 |
| NAPHTHALENES | 0.00 | 0.00 | 0.00 | 100.00 |
| M-NAPHTHALENES | 0.00 | 0.00 | 0.00 | |
| $C_{13}$+'S | 0.00 | 0.00 | 0.00 | |
| WT % CONV, TOTAL | 8.48 | 1.53 | 1.88 | |
| TO $C_1$–$C_4$ | 0.86 | 0.21 | 0.37 | |

TABLE 11-continued

| | | | |
|---|---|---|---|
| R + O (CHARGE = 89.8) | 92.80 | 92.20 | 92.10 |

[3]Steamed $\alpha$ = 13.

TABLE 13

FULL RANGE FCC GASOLINE OVER STEAMED H-ZSM-5, $\alpha$ = 10

| CATALYST | ZSM-5 | ZSM-5 | ZSM-5 |
|---|---|---|---|
| TEMPERATURE, °F. | 301.00 | 501.00 | 650.00 |
| PRESSURE, PSIG | 30.00 | 30.00 | 30.00 |
| WHSV | 10.00 | 10.00 | 10.00 |
| HELIUM, HC | 0.00 | 0.00 | 0.00 |
| TIME ON STREAM, HRS. | 20.80 | 44.20 | 66.00 |
| PRODUCT DIST., WT % | | | |
| $C_1$ | 0.00 | 0.00 | 0.00 |
| $C_2$ | 0.00 | 0.00 | 0.00 |
| $C_2$= | 0.00 | 0.00 | 0.00 |
| $C_3$ | 0.00 | 0.00 | 0.00 |
| $C_3$= | 0.01 | 0.00 | 0.05 |
| ISO-$C_4$ | 0.03 | 0.03 | 0.03 |
| N-$C_4$ | 0.15 | 0.16 | 0.17 |
| $C_4$= | 0.41 | 0.39 | 0.47 |
| ISO-$C_5$ | 7.17 | 7.20 | 7.13 |
| N-$C_5$ | 0.22 | 0.24 | 0.23 |
| $C_5$= | 8.28 | 8.32 | 8.37 |
| 2,2 DM-$C_4$ | 0.07 | 0.09 | 0.08 |
| CYCLO-$C_5$ | 0.72 | 0.73 | 0.33 |
| 2,3 DM-$C_4$ | 0.66 | 0.66 | 0.90 |
| 2-M-$C_5$ | 3.88 | 3.91 | 3.80 |
| 3-M-$C_5$ | 2.13 | 2.15 | 2.13 |
| N-$C_6$ | 0.99 | 0.98 | 0.95 |
| $C_6$= | 3.46 | 3.51 | 3.40 |
| M-CYCLO-$C_5$ | 2.63 | 2.67 | 2.70 |
| BENZENE | 1.53 | 1.47 | 1.52 |
| CYCLO-$C_6$ | 0.23 | 0.32 | 0.25 |
| $C_7$'S | 11.74 | 11.99 | 11.91 |
| N-$C_7$ | 0.00 | 0.00 | 0.00 |
| TOLUENE | 4.77 | 4.84 | 4.77 |
| $C_8$'S | 6.53 | 6.70 | 6.73 |
| N-$C_8$ | 0.00 | 0.00 | 0.00 |
| $C_8$ AR. | 10.13 | 10.11 | 10.06 |
| $C_9$+ PAR. | 0.00 | 0.00 | 0.00 |
| $C_9$ AR. | 10.16 | 10.08 | 10.12 |
| $C_{10}$ AR. | 8.77 | 8.65 | 8.74 |
| $C_{10}$–$C_{12}$ AR. | 15.26 | 14.79 | 15.16 |
| NAPHTHALENES | 0.00 | 0.00 | 0.00 |

TABLE 13-continued

| FULL RANGE FCC GASOLINE OVER STEAMED H-ZSM-5, $\alpha = 10$ | | | |
|---|---|---|---|
| M-NAPHTHALENES | 0.00 | 0.00 | 0.00 |
| $C_{13}$+'S | 0.01 | 0.01 | 0.00 |
| WT % CONV, TOTAL | 2.43 | 2.03 | 3.24 |
| TO $C_1$–$C_4$ | 0.12 | 0.11 | 0.25 |
| R + O (CHARGE = 89.3) | 89.10 | 88.90 | 89.40 |

TABLE 14

| FULL RANGE FCC GASOLINE OVER STEAMED H-ZSM-5, $\alpha = 10$ | | | |
|---|---|---|---|
| CATALYST | ZSM-5 | ZSM-5 | ZSM-5 |
| TEMPERATURE, °F. | 704.00 | 700.00 | 726.00 |
| PRESSURE, PSIG | 400.00 | 400.00 | 200.00 |
| WHSV | 10.00 | 10.00 | 10.00 |
| HELIUM, HC | 0.00 | 0.00 | 0.00 |
| TIME ON STREAM, HRS. | 25.80 | 45.30 | 73.80 |
| PRODUCT DIST., WT % | | | |
| $C_1$ | 0.00 | 0.00 | 0.00 |
| $C_2$ | 0.00 | 0.00 | 0.00 |
| $C_2$= | 0.02 | 0.01 | 0.01 |
| $C_3$ | 0.00 | 0.00 | 0.00 |
| $C_3$= | 0.30 | 0.16 | 0.31 |
| ISO-$C_4$ | 0.03 | 0.02 | 0.03 |
| N-$C_4$ | 0.18 | 0.14 | 0.19 |
| $C_4$= | 0.65 | 0.47 | 0.69 |
| ISO-$C_5$ | 6.70 | 6.41 | 6.94 |
| N-$C_5$ | 0.16 | 0.17 | 0.19 |
| $C_5$= | 6.90 | 7.09 | 7.61 |
| 2,2 DM-$C_4$ | 0.03 | 0.02 | 0.03 |
| CYCLO-$C_5$ | 0.57 | 0.59 | 0.62 |
| 2,3 DM-$C_4$ | 0.71 | 0.65 | 0.70 |
| 2-M-$C_5$ | 3.79 | 3.67 | 3.81 |
| 3-M-$C_5$ | 0.11 | 2.04 | 2.09 |
| N-$C_6$ | 1.05 | 1.05 | 1.01 |
| $C_6$= | 2.88 | 3.00 | 3.12 |
| M-CYCLO-$C_5$ | 2.73 | 2.88 | 2.74 |
| BENZENE | 1.40 | 1.37 | 1.44 |
| CYCLO-$C_6$ | 0.47 | 0.38 | 0.44 |
| $C_7$'S | 11.56 | 11.62 | 11.62 |
| N-$C_7$ | 0.00 | 0.00 | 0.00 |
| TOLUENE | 4.68 | 4.78 | 4.76 |
| $C_8$'S | 7.06 | 7.08 | 6.99 |
| N-$C_8$ | 0.00 | 0.00 | 0.00 |
| $C_8$ AR. | 10.32 | 10.43 | 10.25 |
| $C_9$+ PAR. | 0.00 | 0.00 | 0.00 |
| $C_9$ AR. | 10.53 | 10.71 | 10.29 |
| $C_{10}$ AR. | 9.36 | 9.40 | 8.96 |
| $C_{10}$–$C_{12}$ AR. | 15.89 | 16.05 | 15.15 |
| NAPHTHALENES | 0.00 | 0.00 | 0.00 |
| M-NAPHTHALENES | 0 00 | 0.00 | 0.00 |
| $C_{13}$+'S | 0.00 | 0.00 | 0.00 |
| WT % CONV, TOTAL | 4.08 | 4.21 | 2.81 |
| TO $C_1$–$C_4$ | 0.63 | 0.31 | 0.65 |
| R + O (CHARGE = 89.2) | 88.80 | 89.30 | 89.20 |

TABLE 15

| REACTION OF FULL RANGE FCC GASOLINE OVER STEAMED H-ZSM-12, $\alpha = 11$ | | |
|---|---|---|
| CATALYST | ZSM-12 | ZSM-12 |
| TEMPERATURE, °F. | 899.00 | 861.00 |
| PRESSURE, PSIG | 30.00 | 30.00 |
| WHSV | 10.00 | 10.00 |
| $H_2$, HC | 2.10 | 2.10 |
| TIME ON STREAM, HRS. | 23.50 | 95.50 |
| PRODUCT DIST., WT % | | |
| $C_1$ | 0.00 | 0.00 |
| $C_2$ | 0.04 | 0.01 |
| $C_2$= | 0.07 | 0.01 |
| $C_3$ | 0.03 | 0.01 |
| $C_3$= | 1.60 | 0.33 |
| ISO-$C_4$ | 0.04 | 0.02 |
| N-$C_4$ | 0.28 | 0.16 |
| $C_4$= | 2.10 | 0.84 |
| ISO-$C_5$ | 6.84 | 6.58 |

TABLE 15-continued

| REACTION OF FULL RANGE FCC GASOLINE OVER STEAMED H-ZSM-12, $\alpha = 11$ | | |
|---|---|---|
| N-$C_5$ | 0.17 | 0.13 |
| $C_5$= | 8.68 | 8.08 |
| 2,2 DM-$C_4$ | 0.08 | 0.10 |
| CYCLO-$C_5$ | 0.67 | 0.67 |
| 2,3 DM-$C_4$ | 0.66 | 0.68 |
| 2-M-$C_5$ | 3.96 | 3.96 |
| 3-M-$C_5$ | 2.13 | 2.15 |
| N-$C_6$ | 1.10 | 1.10 |
| $C_6$= | 3.07 | 3.28 |
| M-CYCLO-$C_5$ | 2.76 | 2.79 |
| BENZENE | 1.46 | 1.51 |
| CYCLO-$C_6$ | 0.30 | 0.33 |
| $C_7$'S | 10.83 | 12.00 |
| N-$C_7$ | 0.00 | 0.00 |
| TOLUENE | 4.72 | 4.76 |
| $C_8$'S | 5.91 | 6.66 |
| N-$C_8$ | 0.00 | 0.00 |
| $C_8$ AR. | 9.89 | 10.08 |
| $C_9$+ PAR. | 0.00 | 0.00 |
| $C_9$ AR. | 9.66 | 9.99 |
| $C_{10}$ AR. | 8.42 | 8.73 |
| $C_{10}$–$C_{12}$ AR. | 14.59 | 15.05 |
| NAPHTHALENES | 0.00 | 0.00 |
| M-NAPHTHALENES | 0.00 | 0.00 |
| $C_{13}$+'S | 0.00 | 0.00 |
| WT % CONV, TOTAL | 5.37 | 3.44 |
| TO $C_1$–$C_4$ | 3.37 | 0.76 |
| R + O (CHARGE = 89.1) | 91.10 | 90.00 |

EXAMPLE 6

In order to determine the olefin content of the cracked gases, a full range FCC gasoline was converted over a steamed ZSM-5 catalyst. Composition of the product is shown in Table 16.

While the amount of light gas produced is small, it is primarily $C_3$–$C_4$ olefins which can be used to increase alkylate yield.

The $C_5$+ yield is 98.1 vol.% with 1.5 wt.% $C_1$–$C_4$ make. The volume of isobutane required for alkylation is 2.8%, giving a gasoline plus alkylate yield of 102.2+ vol.%.

TABLE 16

| | |
|---|---|
| CATALYST | ZSM-5 |
| TEMPERATURE, °F. | 724.00 |
| PRESSURE, PSIG | 30.00 |
| WHSV | 10.00 |
| HELIUM, HC | 0.00 |
| TIME ON STREAM, HRS. | 119.00 |
| PRODUCT DIST., WT % | |
| $C_1$ | 0.00 |
| $C_2$ | 0.00 |
| $C_2$= | 0.02 |
| $C_3$ | 0.00 |
| $C_3$= | 0.48 |
| ISO-$C_4$ | 0.03 |
| N-$C_4$ | 0.22 |
| $C_4$= | 1.05 |
| ISO-$C_5$ | 6.15 |
| N-$C_5$ | 0.21 |
| $C_5$= | 10.19 |
| 2,2 DM-$C_4$ | 0.00 |
| CYCLO-$C_5$ | 0.86 |
| 2,3 DM-$C_4$ | 0.55 |
| 2-M-$C_5$ | 3.30 |
| 3-M-$C_5$ | 1.69 |
| N-$C_6$ | 1.21 |
| $C_6$= | 3.77 |
| M-CYCLO-$C_5$ | 2.82 |
| BENZENE | 1.78 |
| CYCLO-$C_6$ | 0.47 |
| $C_7$'S | 11.24 |
| N-$C_7$ | 0.00 |

TABLE 16-continued

| | |
|---|---|
| TOLUENE | 4.87 |
| $C_8$'S | 6.45 |
| N-$C_8$ | 0.00 |
| $C_8$ AR. | 8.96 |
| $C_9$+ PAR. | 0.00 |
| $C_9$ AR. | 10.10 |
| $C_{10}$ AR. | 8.37 |
| $C_{10}$-$C_{12}$ AR. | 15.21 |
| NAPHTHALENES | 0.00 |
| M-NAPHTHALENES | 0.00 |
| $C_{13}$+'S | 0.00 |
| WT % CONV, TOTAL | 2.95 |
| TO $C_1$-$C_4$ | 1.12 |
| R + O (CHARGE = 91.4) | 92.80 |

What is claimed is:

1. A process for improving the octane value of an olefinic gasoline comprising aromatic, paraffinic and olefinic components, which method comprises contacting the olefinic gasoline with an acidic crystalline zeolite having an alpha value of 5 to 100 and a constraint index of 1 to 12 in the absence of hydrogen at a pressure of 0 to 50 psig and at a temperature of at least 700° F. to effect a conversion of from 0.5 to 5 weight percent to $C_1$ to $C_4$ products, to effect an increase in the octane number of the gasoline.

2. A process according to claim 1 in which the aromatic content of the gasoline, and the carbon number of the paraffin and olefin components of the feed are substantially constant.

3. A process according to claim 1 in which the gasoline is contacted with the zeolite at a temperature of 700° to 900° F.

4. A process according to claim 1 in which the gasoline is contacted with the zeolite at a space velocity of at least 10 WHSV.

5. A process according to claim 1 in which the zeolite is ZSM-5.

6. A process according to claim 1 in which the zeolite has an alpha value of 10 to 50.

7. A process according to claim 1 in which the gasoline contains at least 20 percent by weight olefins.

8. A process according to claim 1 in which the gasoline contains at least 30 percent by weight olefins.

9. A process according to claim 1 in which the gasoline which is contacted with the zeolite is a 75° to 310° F. gasoline fraction.

10. A process according to claim 1 in which the gasoline which is contacted with the zeolite is a 75° to 250° F. gasoline fraction.

11. A process according to claim 1 in which the gasoline is an olefinic gasoline produced by a catalytic cracking process.

12. A process according to claim 1 in which the gasoline is contacted with a fixed bed of the zeolite.

13. A process according to claim 1 in which the zeolite is ZSM-12.

14. A process according to claim 13 in which the ZSM-12 has an alpha value of 10 to 50.

15. A process accordng to claim 5 in which the ZSM-5 has an alpha value of 10 to 50.

* * * * *